US005922147A

United States Patent [19]

Valtierra-Gallardo et al.

[11] Patent Number: 5,922,147

[45] Date of Patent: *Jul. 13, 1999

[54] METHOD AND APPARATUS FOR SIMPLIFIED PRODUCTION OF HEAT-TREATABLE ALUMINUM ALLOY CASTINGS

[75] Inventors: Salvador Valtierra-Gallardo, Coahuila; Juan Francisco Mojica-Briseño; Oscar Garza-Ondarza, both of Nuevo León, all of Mexico

[73] Assignee: Tenedora Nemak, S.A. de C.V., Garcia, Mexico

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,812

[22] Filed: Jan. 30, 1997

Related U.S. Application Data

[63] Continuation of application No. 08/444,400, May 19, 1995, abandoned.

[51] Int. Cl.[6] ..... C22F 1/04

[52] U.S. Cl. ..... 148/549; 148/698; 148/699; 148/700

[58] Field of Search ..... 148/549, 698, 148/699, 700, 701, 702

[56] References Cited

U.S. PATENT DOCUMENTS

| | | | |
|---|---|---|---|
| 1,732,573 | 10/1929 | Welty | 148/416 |
| 2,062,329 | 12/1936 | Nock, Jr. | 148/416 |
| 4,419,143 | 12/1983 | Ito et al. | 148/416 |

FOREIGN PATENT DOCUMENTS

| | | |
|---|---|---|
| A-0 485 068 | 5/1992 | European Pat. Off. . |
| A-37 10901 | 8/1962 | Japan . |
| 55-110753 | 8/1980 | Japan . |
| A-01 283336 | 2/1990 | Japan . |
| A-390 244 | 4/1933 | United Kingdom . |
| A-547 217 | 8/1942 | United Kingdom . |

OTHER PUBLICATIONS

Metals Handbook, 9th Ed., vol. 15 (Casting); ASM International, 1988; Metals Park, Ohio; pp. 757–759.

Metals Handbook, 9th Ed., vol. 4 (Heat Treating); ASM International, 1981; Metals Park, Ohio; pp. 704–706.

Journal of Heat Treating, vol. 8, No. 1, Jan. 1, 1990, pp. 63–70, XP000140706, Shivkumar S et al: "Effect of Solution Treatment Parameters on Tensile Properties of Cast Aluminum Alloys".

*Primary Examiner*—George Wyszomierski
*Attorney, Agent, or Firm*—A. Thomas s. Safford; Frommer Lawrence & Haug LLP

[57] ABSTRACT

Method and apparatus for simplified heat-treatment to harden aluminum castings made from heat-treatable aluminum alloys, especially with a copper content of up to 5%, such as the 300-T6 series, for example those cast aluminum parts utilized in the manufacture of automobile motors: cylinder heads, engine blocks and the like; whereby the castings are directly quenched before cooling below 400° C. (and preferably immediately after demolding) without undergoing the conventional steps of natural cooling followed by a re-heating "solution" heat treatment (typically of at least 470° C. for at least two hours, or for a shorter time at higher temperatures) which "solution" heat treatment requires excessive and expensive equipment, energy, and production time. This invention also has the unexpected beneficial effect of avoiding development of silicon spheroidization in the alloy matrix thereby resulting in improved machining properties.

20 Claims, 2 Drawing Sheets

METHOD AND APPARATUS FOR SIMPLIFIED PRODUCTION OF HEAT-TREATABLE ALUMINUM ALLOY CASTINGS

This application is a continuation of application Ser. No. 08/444,400, filed May 19, 1995, now abandoned.

FIELD OF THE INVENTION

The present invention relates to improved methods and simplified apparatus for heat treatment to harden aluminum castings, more particularly, castings made from heat treatable aluminum alloys, preferably such as the copper-containing 300 series (or more typically referred to as the 3xx.x series, from the American classification system of the Aluminum Association (AA)), including for example those used to cast aluminum parts of the type utilized in the manufacture of automobile and aviation internal combustion engines: cylinder heads, engine blocks and the like; whereby according to this invention the castings are directly quenched immediately after demolding to obtain superior aluminum castings without undergoing the conventional step of "solution" heat treatment (previously thought necessary to produce castings of such quality), thereby eliminating expensive equipment and related energy and production time.

In its broader aspects, this invention is applicable to any aluminum alloy system having significant precipitation hardening with meaningful benefit from "solution" heat treating. Where solution heating has proven to be useful, the prior art teaches this step to be a requisite in the casting finishing process to achieve proper hardening. These would include aluminum alloys with magnesium combined with copper, or zinc, or all three, or silicon). These aluminum alloys are termed "heat-treatable" alloys to distinguish them from those alloys for which the solution heating gives no significant strengthening. Only for such non-heat-treatable alloys does the prior art recognize precipitation heat treating without prior solution heat treatment (these latter would include thin extrusion alloys 6061, 6063, 6463 and 7005; which notably are not casting alloys).

The invention provides a process which considerably simplifies the manufacturing of such castings and decreases the capital and operational costs thereof. The inventive process for simplified heat treating of castings unexpectedly also has the additional benefit of avoiding silicon spheroidization and keeps a modified structure in the alloy resulting in improved machining properties, due to elimination of the conventional solution heat treating of said castings.

BACKGROUND OF THE INVENTION

Metal castings are heat treated to produce a change in mechanical properties by changing the type and proportion of phases present in the solid state, the morphology of the microconstituents, and the concentration and distribution of crystal defects.

The description will be mainly in terms of copper-containing aluminum alloys, but should be understood to be more broadly applicable, where effective (e.g. some precipitation hardening systems derive strength from $Mg_2Si$ or $MgZn_2$ instead of $CuAl_2$).

Such aluminum alloys (which may contain, for example, generally on the order of up to 5% copper) are currently heat treated for the purpose of improving their mechanical properties by precipitation hardening involving a solution and aging treatment sequence.

Hardening and development of other properties of aluminum-copper alloys require control of the casting and associated heat-treating processes under such conditions so as to maintain in solid solution the copper within the aluminum matrix. Following the casting mold removal, the casting typically is naturally cooled well below 470° C. (often to ambient temperature) prior to the next solution heat treating step (which latter step has the purpose of re-incorporating the copper atoms into the aluminum molecular matrix, to avoid uncontrolled and excessive precipitation of copper as $CuAl_2$; because copper, fully dissolved in the liquid aluminum, naturally tends to precipitate from the aluminum as the temperature decreases from about 500° C. to ambient temperature).

In order to maintain the copper dissolved in the proper amount and in the required form in the alloy to obtain a predetermined level of hardness and strength, such heat-treatable aluminum castings are universally subjected to this traditional solution heat treatment at temperatures above 470° C. (typically in the range between 480° C. and 495° C.) for a certain period of time, usually in the range between at least 2 to 7 hours. The expressed object of this heat treating step is to obtain a homogeneous distribution of fine copper precipitates in the alloy. This solution heat treating, however, incidentally adversely promotes the spheroidization of silicon and consequently somewhat degrades the machining properties of the resulting castings (a condition which the industry for most purposes has learned to accept).

The next manufacturing step is rapidly to quench said castings, without interruption, from the solution heat treatment temperature, e.g. about 480° C., down to a temperature around 85° C., thus maintaining the copper precipitates in the adequate amount and homogeneous distribution in solid solution. Quench cooling may commonly carried down to any of a number of different temperatures and at different rates according to the final properties of the alloy to be emphasized (see "Quenching" discussed in the ASM Handbook, Volume 4 (1991), infra at page 851 et seq. which discloses use of cold water, for near ambient temperatures; boiling water, for 100° C.; polyalkaline glycol, for even higher temperatures; forced air or mist; etc.).

This quenching step produces a supersaturated solid solution that causes the alloy to harden naturally as time passes. Finally in order to accelerate and improve hardening, the castings are maintained at temperatures of about 200° C. in an "aging" furnace. The time spent in the "aging" furnace brings the alloy to at least a partial coherency in its structure giving it the required hardness and strength properties.

For more information on the details of the prior art methods, reference is made to the ASM Handbook, Volume 2 (1990), entitled "Properties and Selection: Nonferrous Alloys and Special Purpose Materials"; and Volume 4 (1991), entitled "Heat Treating" (especially pages 824–879); both being tenth editions, published by ASM International; the contents of which are incorporated herein by reference. See page 833 which speaks of "the required solution heat treatment", page 844 which in discussing "Solution Heat Treating" states that "to take advantage of the precipitation-hardening reaction, it is necessary first to produce a solid solution. The process by which this is accomplished is called solution heat treating," and page 851 where the only indicated exception is discussed in "Precipitation Heat without Prior Solution Heat Treating Treatment", there stating that certain thin extrusion alloys after having been "air cooled or water quenched directly from a final hot-working operation", "develop strengths nearly equal to those obtained by adding a separate solution heat treating operation" [emphases added].

The present invention is based on the applicants' finding that by directly quenching the heat-treatable aluminum casting after demolding, contrary to the current practice of heat treating previously cooled aluminum castings in a solution furnace, the essentially same properties of hardness and strength can be obtained. Some properties may improve and others slightly decrease, but usually not more so than would occur in variations resulting from adjustments in the heat solution treatment made to emphasize one property trait over another (in the usual compromises made in such treatments to achieve the best balance of desirable properties). Even where there may be some decrease, this has been found to be within the usual tolerance levels normally required for the final product.

This invention thus results in multimillion dollar savings in capital investment and upkeep costs of the solution heating treatment furnace and the operational energy costs of such treatment. The casting plants are therefore greatly simplified. This new and simplified heat treating process thus constitutes a significant breakthrough in the art of heat-treatment aluminum alloy casting.

As an example of the heat treating step of the prior art, which is avoided by the present invention, reference is made to U.S. Pat. No. 5,294,094 to Crafton et al. In FIG. 1 of this patent the "solution furnace" is designated by the numeral 11 and as described therein. It comprises a number of zones and is the largest piece of equipment of the plant, involving high capital costs. This patent is addressed to the improvement of such heat treating furnace by performing the sand core removal therein, consequently it does not suggest the elimination of such furnace as the present invention does.

The present invention provides a process which eliminates the traditional "solution furnaces" and produces aluminum alloy castings with similar properties of hardness and strength as those of the prior art. Another advantage of the invention is that silicon spheroidization is avoided improving the machining properties of castings. The effect is that the castings produced according to the invention improve to class A from class B in the classification for aluminum alloys. Aluminum alloys are classified from A to E in increasing order of chip length and decreasing order of quality of finish. Class A is characterized as free cutting, very small broken chips and excellent finish; class B is characterized as curled or easily broken chips and good to excellent finish.

The silicon morphology in the castings is responsible for the machining properties. Silicon takes the form of plates in the naturally solidified alloy, but when the alloy is heated to the solution temperature, after it has been cooled down, then silicon changes to spheroid form which produces continuous curled chips. If the alloy is quenched and aged in accordance with the invention without the solution heating step, the silicon keeps the fibrous structure which advantageously produces short chips.

The time involved in heat-treating for solution of copper has been decreased in a factor of about 4 from the traditional 8–12 hours, e.g. to 2–3 hours according to M. H. Lavington, *The Cosworth Process-a new concept in aluminum alloy casting production,* Metals and Materials, Volume 2, No. 11, November 1986, but the solution treatment has not been eliminated. The applicants are not aware of any proposal from aluminum casting technology suppliers, or of any plant currently operating, which have either suggested or practiced a heat treatment process as in the present invention, i.e. without subjecting said castings to the solution heat treating furnace and instead, contrary to prior art expertise to directly quench the castings to near ambient temperature immediately after demolding, or at least after maintaining the temperature of such casting above 400° C. (in other words, without letting said temperature to fall below 400° C.).

OBJECTS AND SUMMARY OF THE INVENTION

It is therefore an object of the invention to provide a process of manufacturing aluminum alloy castings with improved properties and at lower capital and operational costs.

Other objects of the invention will be in part obvious and in part pointed out hereinafter.

According to the present invention the objects thereof are achieved by providing a method of producing hardened aluminum alloy castings, comprising directly quenching newly formed still-hot heat-treatable aluminum alloy metal, then age hardening (without solution heat treatment). This typically involves the steps of filling a mold with liquid heat-treatable aluminum alloy, cooling sufficiently to form a solidified casting, extracting said casting from said mold at a temperature preferably in the range between 490° C. and 500° C., optionally maintaining the surface temperature of said casting in the range between 490° C. and 400° C. and at a temperature lower than and/or a time less than for a solution heat treatment thereof (such as less than 470° C. and/or from zero to two hours), then immediately quenching said casting, preferably with water, to a temperature generally in the range between 65° C. and 90° C., and without any heat treating step between said mold extraction and said quenching, and aging said casting, preferably in an aging furnace at a temperature between 140° C. and 250° C. for a period of time from two to five hours. As used in this specification, "age hardening" broadly includes not only natural aging at ambient temperatures, but also accelerated aging in an aging furnace (which latter is sometimes distinguishingly referred to as precipitation hardening).

BRIEF DESCRIPTION OF THE DRAWINGS

In this specification and in the accompanying drawings, some preferred embodiments of the invention are shown and described and various alternatives and modifications thereof have been suggested; but it is to be understood that these changes and modifications can be made within the scope of the invention. The suggestions herein are selected and included for purposes of illustration in order that others skilled in the art will more fully understand the invention and the principles thereof and will thus be enabled to modify it in a variety of forms, each as may be best suited to the conditions of a particular use.

DETAILED DESCRIPTION OF PREFERRED EMBODIMENTS OF THE INVENTION

Figure 1:
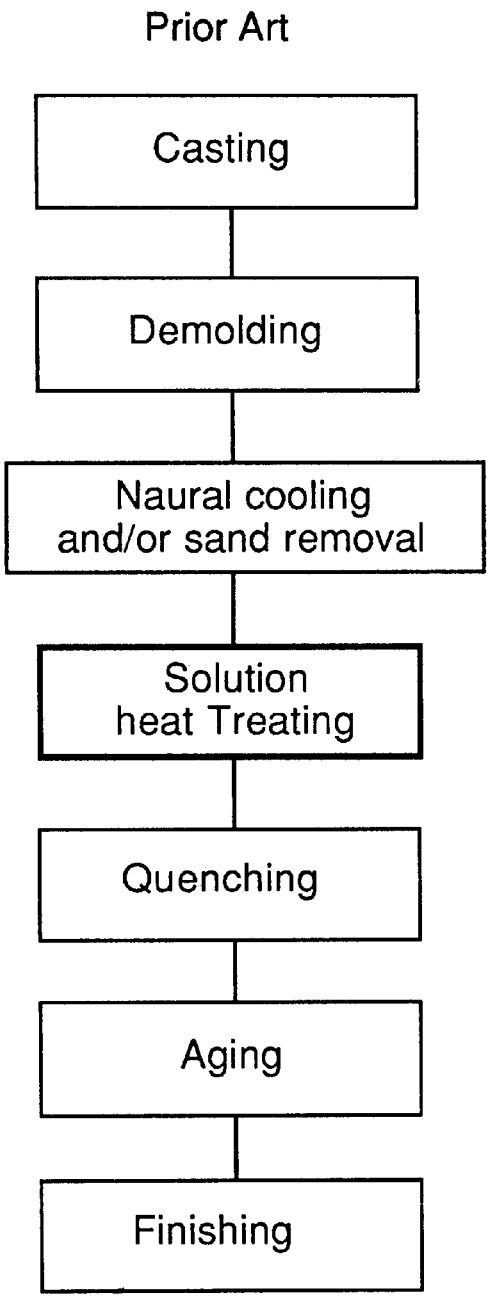
FIG. 1 is a flow diagram showing the process step sequence of the conventional prior art method for producing aluminum castings.

With reference to FIG. 1, the conventional method of casting aluminum parts, for example hollow aluminum castings such as cylinder heads, engine blocks and the like, comprises the following steps: 1) casting liquid aluminum into a suitable mold, usually made of cast iron and having sand cores to form the interior surfaces of the casting; 2) after the aluminum alloy has solidified, removing the castings from the mold at a temperature between 490° C. to 500° C.; 3) normally, allowing castings to cool naturally (usually to ambient temperature) and eventually removing the sand cores (which removal may be carried out after cooling of the castings or during the next heat treating step); 4) heat treating the castings in a tunnel furnace, known as solution furnace, to heat the castings to a predetermined temperature above 470° C. for a given time (normally being at least two hours for a casting of any bulk). As is well known in the art, the time can be shortened by treating at a higher non-melting temperature, but usually at some sacrifice of overall desirable properties (for some cost saving, where such properties are not so critical in the end use). This heat treatment is intended to avoid (if not cooled) or to revert the uncontrolled precipitation of large particles of $CuAl_2$ occurring naturally when the alloy is slowly cooled down (e.g. naturally cooling by exposure to ambient conditions); 5) quenching of the solution heat treated castings, usually with liquid water at a temperature between 65° C. and 95° C., which rapid temperature drop produces a supersaturated solution of copper in the aluminum alloy at the atomic level; 6) aging the castings, which can be natural or preferably in a suitable furnace in order to provide a predetermined rate of cooling of such castings for several hours at a temperature on the order of 200° C. This artificial aging in an aging furnace provides the desired properties of the castings by combining the aging temperature and the time during which the castings are subjected to said temperature. The dissolved copper at atomic level precipitates as $CuAl_2$ but forms small submicroscopic particles in the alloy; and 7) finishing the castings comprising for example: riser cutting, cubing, decoring, machining, deburring, cleaning, etc.as required for delivering the final product.

Figure 2:
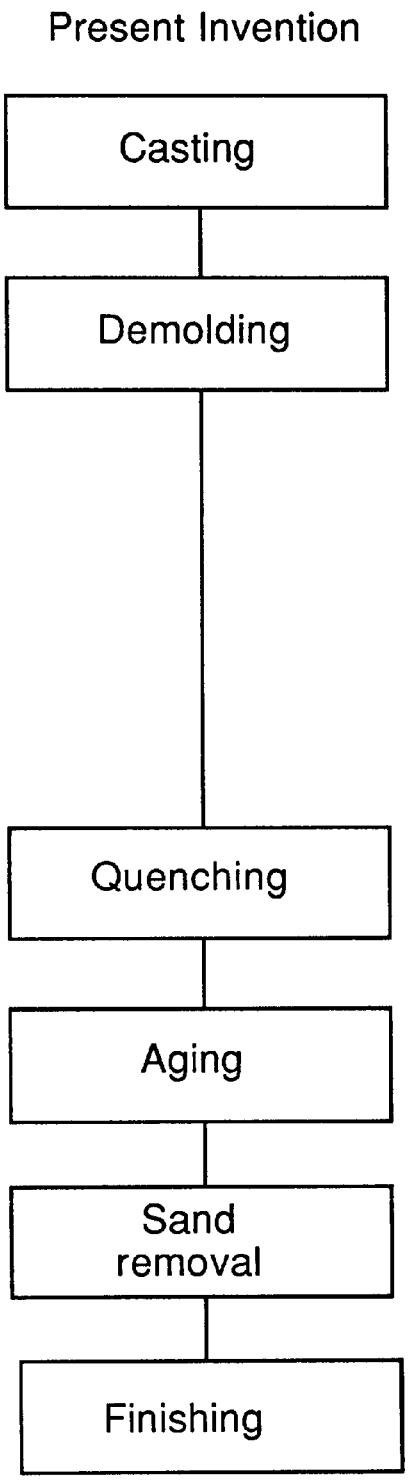
FIG. 2 is a flow diagram showing the process step sequence of the inventive method for producing hardened aluminum castings from a heat-treatable alloy.

The present invention provides a simplified method of producing heat-hardened aluminum alloys castings with significant savings in capital and operational costs illustrated in FIG. 2 for comparison with the process of the prior art, which method comprises 1) introducing liquid heat-treatable aluminum alloy, of a desired composition comprising copper, into a mold to produce a casting; 2) removing from said mold the casting after it has been cooled sufficiently to become solid; 3) quenching said casting, without subjecting it to the solution heat treating of the prior art, while the alloy still has a surface temperature above 350° C., i.e. not permitting said temperature to fall below 350° C. before initiating the quench in order to avoid the formation of large precipitates of $CuAl_2$. This quenching is carried out with liquid water at a temperature between 65° C. and 95° C. in the same manner as in the prior art; 4) aging said casting, for a period normally less than needed for the prior art (though here shown in the range of 2 to 5 hours) at a temperature between 140° C. and 250° C.; 5) removing the sand cores. This step can conveniently be carried out after the aging treatment, because the alloy can now be cooled down without interfering with the hardening process; and 6) finishing the castings, for example, riser cutting, cubing, decoring, machining, etc., as required for delivering the final product.

It will be readily appreciated in view of this teaching by those skilled in the art that eliminating the "solution" furnace while obtaining the same properties in the products, considerably simplifies the aluminum casting process and lowers the production costs thereof.

Figure 3:
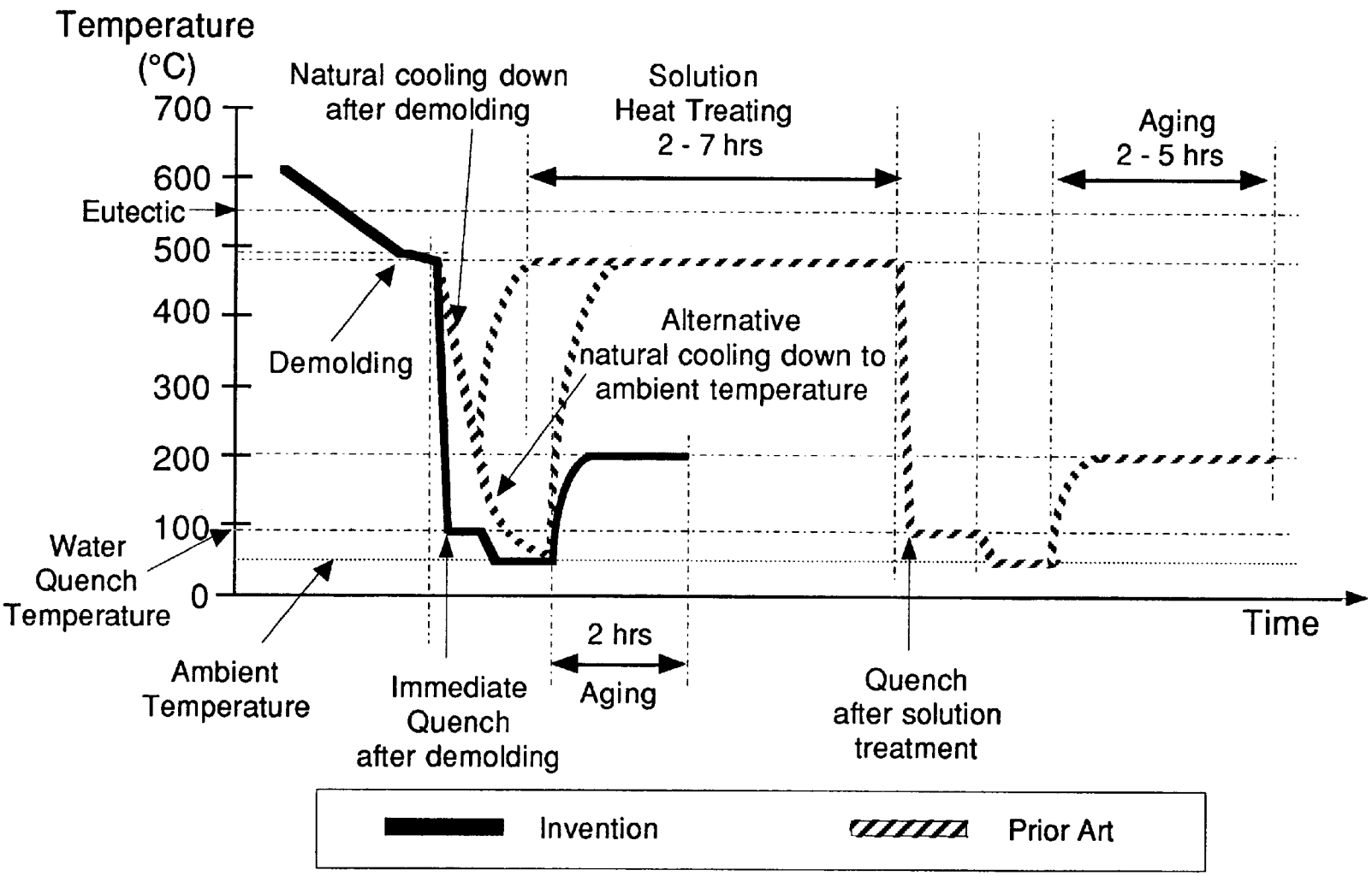
FIG. 3 is a graph showing the different temperature paths followed over time by the heat treatment of the prior art and the heat treatment of the invention (in superimposed plots of temperature of the casting according to both methods vs. time).

Referring now to FIG. 3, the advantages of the invention over the prior art can be readily appreciated in a plot of temperature of the alloy casting vs time. The prior art method is shown as a dotted line and the method of the preferred embodiment of the invention is shown as a solid black line. As can be observed, the invention shortens the manufacturing process of the aluminum alloys by a period of time in the range of at least 2 to 7 hours, which is the time spent by the castings in the conventional solution furnace. The properties of the castings however are within the range required by a conventional heat treatment method, known as T6 by the American Aluminum Association, as illustrated by the following example:

Tests were made with an aluminum Alloy A-319 with the following conditions:

| | Units | Invention | Prior Art |
|---|---|---|---|
| Test Conditions: | | | |
| Temperature at surface of casting before quenching | (° C.) | 430 | 480 |
| Aging time | (hrs) | 2 | 4 |
| Aging temperature | (° C.) | 240 | 240 |
| Test Results (Property): | | | |
| Brinell Hardness | (B) | 109 | 100 |
| Ultimate Tensile Stress | (MPa) | 230 | 240 |
| Elongation | (%) | 1.4 | 1.8 |
| Tensile Yield | (MPa) | 207 | 205 |
| Compression Yield | (MPa) | 203 | 210 |

The lines shown in FIG. 3 are self-explanatory and are drawn of course only for illustration purposes.

The simplification of the heat-treating process by eliminating the large solution heat treating furnace is so advantageous that this invention is still a significant improvement even in the case when a small furnace is used for holding the castings after demolding (the only purpose thereof being to prevent the temperature of the casting from falling down below 400° C., such as to accommodate delay in the processing line or for short term maintenance). If the temperature of the castings falls down below 400° C. (without the direct precipitation quench step, contrary to the present invention), then the precipitation of large particles of $CuAl_2$ occurs, and it then becomes mandatory to subject the castings to the normal solution heat treating step in order to revert these precipitates to a solid solution of copper in aluminum at the atomic level.

In order to explain the importance of the present invention in the aluminum casting industry, it can be pointed out that a solution furnace, eliminated by the invention, is a piece of equipment costing several millions of dollars. Its omission decreases the capital costs of a casting plant by about 50%. Furthermore, the energy saved by not operating such a furnace is a significant amount considering the cost of heating, for example 800,000 pieces per year, each weighing about 30 Kg, plus the weight of the casting holding basket, 20 to 30 Kg, from ambient temperature, i.e. 25° C. to 35° C., to the solution temperature of about 480° C. and maintaining such temperature for several hours.

Although the invention has been exemplified by the preferred embodiment of an Al—Cu alloy system, it is of course to be understood that the foregoing description is intended to be illustrative only and that numerous changes can be made in the structure of the system described and its operating conditions without departing from the spirit of the invention as defined in the appended claims. For example, the benefits are applicable broadly to castings made from other disclosed aluminum alloy systems whose phase diagrams would indicate slightly different critical temperatures from those temperatures recited above for specific aluminum-copper systems. Also, although immediate direct quench after demolding is usually preferred, simplified apparatus employing a small furnace can be used for holding the castings after demolding (whose only purpose is for preventing the temperature of the casting from falling below 400° C., when the pieces have to spend a certain time waiting for the immediate quench, e.g. during slow-downs, short term maintenance, etc.). As previously indicated, the invention in its broader aspects can be applicable to other aluminum alloys and heat treating processes wherein the solution furnace step is normally used but when the desired properties can be obtained without such solution step (as can be readily determined once in possession of this teaching).

What is claimed is:

1. A method for production of a metal casting with temper properties which are at least equivalent to those that would result from solution heat treatment, quenching and age hardening of said casting, which casting is formed from a heat-treatable aluminum alloy of the 3xx.x series according to the Aluminum Association (AA) classification having Al, Si, & Cu or Mg as the principal constituents, comprising cooling a liquid aluminum alloy of said series to no less than 350° C. to form a hot solidified metal casting, then, without prior solution heat treatment, directly quench cooling said hot solidified metal casting while still at 350° C. or above, and age hardening said quenched metal casting, whereby the resultant metal casting has properties of hardness and strength at least substantially equal to the properties which would result from naturally cooling such a casting of the same alloy to well below precipitation temperature followed by a solution heat treatment prior to the quench cooling and age hardening.

2. A method according to claim 1, wherein said solidified casting after having been extracted from a mold is maintained above 400° C. for a time prior to the direct quench cooling which is thereafter initiated while the casting is still above 400° C.

3. A method according to claim 1, wherein when quenching is initiated the solidified casting has a surface temperature of 400° C. or above, said alloy is copper-containing, and said aluminum alloy casting has properties at least equivalent to a casting having a T6 temper.

4. A method according to claim 3, wherein said aging is done in an aging furnace at a temperature between 140° C. and 250° C. for a period of time from two to five hours.

5. A method according to claim 4, wherein said alloy comprises up to 5% of copper, and wherein the quenching step comprises a cooling of said hot casting at a rate sufficiently rapid to significantly inhibit progress of copper precipitation and to maintain the copper in supersaturated solution within an aluminum matrix.

6. A method according to claim 5, wherein said quenching is done with water and brings the casting down to a temperature in the range between 65° C. and 95° C.

7. A method for production of a metal casting with temper properties which are at least equivalent to those that would result from solution heat treatment, quenching and age harding of said casting, which casting is formed from a heat-treatment hardenable copper-containing aluminum alloy of the 3xx.x series according to the Aluminum Association (AA) classification, consisting essentially of cooling the aluminum alloy, which consists essentially of Al, Si, & Cu, from a liquid state to no less than 350° C. to form hot solidified metal casting, then directly quench cooling said hot solidified metal casting while still at 350° C. or above, and age hardening said metal casting.

8. A method according to claim 7, comprising the further step of holding said hot solidified casting for an extended time at a temperature no less than 400° C. to retain the alloying elements in solution prior to said direct quench cooling and then thereafter from such latter temperature proceeding with direct quenching.

9. A method according to claim 7, wherein when quenching is initiated the solidified casting has a surface temperature of 400° C. or above and said aluminum alloy casting has properties at least equivalent to a casting having a T6 temper.

10. A method according to claim 9, wherein prior to quenching the solidified casting has a surface temperature of 400° C. or above, and wherein said quenching brings the casting down to a temperature in the range between 65° C. and 95° C.

11. A method for production of a metal casting with temper properties which are at least equivalent to those that would result from solution heat treatment, quenching and age hardening of said casting, which casting is formed from a heat-treatable copper-containing aluminum alloy of the 3xx.x series according to the Aluminum Association (AA) classification, said method comprising cooling the aluminum alloy from a liquid state to form a hot solidified metal casting, then, without prior solution heat treatment, promptly directly quench cooling said hot solidified metal casting before the temperature of the metal casting drops below the point where copper begins to precipitate out significantly, and age hardening said quenched metal casting, whereby the resultant metal casting has properties of hardness and strength at least substantially equal to the properties which would result from naturally cooling such a casting of the same alloy to well below precipitation temperature followed by a solution heat treatment prior to the quench cooling and age hardening.

12. A method according to claim 11, wherein said aluminum alloy casting has properties at least equivalent to a casting having a T6 temper.

13. A method according to claim 12, wherein the quench is initiated at a temperature above 350° C.

14. A method according to claim 13, wherein said alloy comprises up to 5% of copper, and wherein the quenching step comprises a cooling of said hot casting at a rate sufficiently rapid to significantly inhibit progress of copper precipitation and to maintain the copper in supersaturated solution within an aluminum matrix.

15. A method according to claim 14, wherein when quenching is initiated the solidified casting has a surface temperature of 400° C. or above.

16. A method according to claim 15, wherein said aging is in an aging furnace at a temperature between 140° C. and 250° C. for a period of time from two to five hours.

17. A method according to claim 16, wherein said quenching is done with water to bring the casting down to a temperature in the range between 65° C. and 95° C.

18. A method according to claim 17, wherein the casting is extracted from a mold at a temperature in the range of about 490° C. to 500° C.

19. A method according to claim 18, further comprising forming the hot solidified metal casting by filling a mold with a liquid heat-treatable aluminum alloy of said series, cooling sufficiently to form the hot solidified casting, and extracting said hot casting from said mold.

20. A method according to claim 19, wherein said alloy also contains Mg.

* * * * *

UNITED STATES PATENT AND TRADEMARK OFFICE

CERTIFICATE OF CORRECTION

PATENT NO : 5,922,147

DATED : July 13, 1999

INVENTOR(S) : Salvador Valtierra-Gallardo

It is certified that error appears in the above-identified patent and that said Letters Patent is hereby corrected as shown below:

Column 4, line 29, at the end of the line after "any", insert --"solution"--.

IN THE CLAIMS:

3. A method according to claim [1] 5, wherein when quenching is initiated the solidified casting has a surface temperature of 400°C or above, said alloy is copper-containing, and said aluminum alloy casting has properties at least equivalent to a casting having a T6 temper.

4. A method according to claim [3] 1, wherein said aging is done in an aging furnace at a temperature between 140°C and 250°C for a period of time from two to five hours.

12. A method according to claim [11] 16, wherein said aluminum alloy casting has properties at

UNITED STATES PATENT AND TRADEMARK OFFICE

CERTIFICATE OF CORRECTION

PATENT NO. : 5,922,147

DATED : Jul. 13, 1999

INVENTOR(S) : Salvador Valtierra-Gallardo

It is certified that error appears in the above-identified patent and that said Letters Patent is hereby corrected as shown below:

least equivalent to a casting having a T6 temper.

13. A method according to claim [12] 11, wherein the quench is initiated at a temperature above 350°C.

Add the following claims:

25. A method according to claim 1, wherein said casting is made from an A319 aluminum alloy.

26. A method according to claim 9, wherein said casting is made from an A319 aluminum alloy.

UNITED STATES PATENT AND TRADEMARK OFFICE

CERTIFICATE OF CORRECTION

PATENT NO. : 5,922,147

DATED : Jul. 13, 1999

INVENTOR(S) : Salvador Valtierra-Gallardo

It is certified that error appears in the above-identified patent and that said Letters Patent is hereby corrected as shown below:

27. A method according to claim 12, wherein said casting is made from an A319 aluminum alloy.

Signed and Sealed this

Twenty-first Day of March, 2000

*Attest:*

*Attesting Officer*

Q. TODD DICKINSON

*Commissioner of Patents and Trademarks*